United States Patent [19]

Ito

[11] Patent Number: 4,953,369

[45] Date of Patent: Sep. 4, 1990

[54] WASHING MACHINE

[75] Inventor: Michiaki Ito, Seto, Japan

[73] Assignee: Kabushiki Kaisha Toshiba, Kawasaki, Japan

[21] Appl. No.: 397,954

[22] Filed: Aug. 23, 1989

[30] Foreign Application Priority Data

Aug. 26, 1988 [JP] Japan ..... 63-213049
Nov. 25, 1988 [JP] Japan ..... 63-299200

[51] Int. Cl.[5] ..... D06F 37/40

[52] U.S. Cl. ..... 68/23.7; 192/41 S; 192/55

[58] Field of Search ..... 68/23.7; 192/41 S, 55

[56] References Cited

U.S. PATENT DOCUMENTS

| | | | |
|---|---|---|---|
| 2,751,773 | 6/1956 | Woodson | 192/41 S |
| 3,090,472 | 5/1963 | Morrison | 68/23.7 X |
| 4,232,536 | 11/1980 | Koseki et al. | 68/23.7 X |
| 4,825,988 | 5/1989 | Nishimura | 192/41 S X |

FOREIGN PATENT DOCUMENTS 63-214288 9/1988 Japan .

*Primary Examiner*—Philip R. Coe

*Attorney, Agent, or Firm*—Foley & Lardner, Schwartz, Jeffery, Schwaab, Mack, Blumenthal & Evans

[57] ABSTRACT

An automatic washing machine includes a coiled clutch spring would about both tub and drive shafts so as to be tightly wound up about the tub shaft and wound up with rotation of the drive shaft to transmit rotation of the drive shaft to the tub shaft, an inner cylindrical member disposed so as to enclose the clutch spring and having an engagement portion engaging one end of the clutch spring at the drive shaft side, an outer cylindrical member having a large number of engagement claws formed on the outer periphery and fitted in with the inner cylindrical member so as to be rotatable with a predetermined frictional resistance against the inner cylindrical member. When the clutch spring is loosened a predetermined amount in the rotative movement in its loosening direction against the braking force of a brake mechanism applied to the tube shaft, the other end of the clutch spring strikes against the stopper. Subsequently, the stopper causes the inner cylindrical member to rotatively move relative to the outer cylindrical member against the frictional resistance upon movement of the other end of the clutch spring.

8 Claims, 9 Drawing Sheets

WASHING MACHINE

BACKGROUND OF THE INVENTION

The present invention relates to washing machines wherein a clutch spring is employed for engagement and disengagement between a drive shaft rotated by an electric motor and a tub shaft for rotating a rotating tub.

In automatic washing machines, generally, an agitator provided in a rotating tub is forward and reverse rotated in each of wash and rinse steps and the rotating tub and agitator are rotated in one direction in a dehydration step. Since a single electric motor is provided in such a washing machine, the same is provided with a clutch for controlling transmission of the motor torque and a brake mechanism for restraining the free rotation of the rotating tub in the wash step, and the like.

FIGS. 7 and 8 illustrate one of the above-described type automatic washing machines. Referring to FIG. 7, a water receiving tub 1 is resiliently suspended in a cabinet 2. A rotating tub 3 is provided in the water receiving tub 1 and an agitator 4 is provided in the rotating tub 3. An electric motor 5 is mounted on the underside of the water receiving tub 1. A drive control mechanism 6 is also provided on the underside of the water receiving tub 1. The drive control mechanism 6 comprises a clutch and a brake mechanism. Referring now to FIG. 8 schematically illustrating the drive control mechanism 6, a drive shaft 7 is integral with a pulley 8. Rotational force of the motor 5 is transmitted to the drive shaft 7 through a transmission mechanism 11 comprising a pulley 9 secured to a rotational shaft 5*a* of the motor 5 and a belt 10 provided between the pulleys 8 and 9, as shown in FIG. 7. The drive shaft 7 is disposed so that a hollow cylindrical tub shaft 12 is adjacent to the upper end of the drive shaft 7 in coaxial relation. A hollow follower shaft 13 is integral with the tub shaft 12 and the diameter of the coupling portion of each of the follower shaft 13 and the tub shaft 12 is rendered larger, thereby constituting a gear case 14. The follower shaft 13 is directly coupled to the rotating tub 3. Accordingly, the tub shaft 12 is coupled to the rotating tub 3. Upon rotation of the tub shaft 12, the gear case 14, follower shaft 13 and rotating tub 3 are rotated with the tub shaft 12. An agitator shaft 15 is inserted in the hollow interior of the tub shaft 12 and directly coupled to the drive shaft 7. The agitator shaft 15 serves as an input shaft of a reduction gear mechanism 16 provided in the gear case 14. A follower shaft 17 serving as an output shaft of the reduction gear mechanism 16 is projected into the rotating tub 3 through the hollow interior of the follower shaft 13. The agitator 4 is coupled to the projected end of the follower shaft 17 and accordingly, rotated by the agitator shaft 15. The gear case 14 also serves as a brake drum of a brake mechanism 18. A brake band 20 to which a brake shoe 19 is secured is mounted on the outer periphery of the gear case 14.

A coiled clutch spring 21 is disposed about portions of the outer peripheral surfaces of the drive and tub shafts 7 and 12. The clutch spring 21 is tightly wound up about the tub shaft 12. Upon rotation of the drive shaft 7, the clutch spring 21 is adapted to be wound up to thereby transmit rotation of the drive shaft 7 to the tub shaft 12. The clutch spring 21 is formed so that the portion 21*a* thereof wound up at the tub shaft side has a diameter smaller than the portion 21*b* thereof wound at the drive shaft side, in the free state, as shown in FIG. 9. Consequently, in the state that the clutch spring 21 is disposed about the outer peripheral surfaces of the drive and tub shafts 7 and 12, the degree of winding of the portion 21*a* at the tub shaft side is higher than that of the portion 21*b* at the drive shaft side. The reason for this is that the transverse length of the portion 21*a* of the clutch spring 21 is reduced by increasing the degree of winding of the portion 21*a*, thereby reducing the axial length of the clutch spring 21. One end 21*c* of the clutch spring 21 (drive shaft side) is engaged with a sleeve 22 having a large number of engagement claws 22*a* on the entire outer periphery, as shown in FIG. 8. A clutch lever 23 is disposed so as to disengageably engage any one of the engagement claws 22*a* of the sleeve 22. More specifically, the clutch lever 23 engages any one of the engagement claws 22*a* whatever angular position the clutch spring 21 occupies. Therefore, whatever angular position the clutch spring 21 occupies, the end 21*c* thereof is fixed at the angular position when the clutch lever 23 engages any one of the engagement claws 22*a* of the sleeve 22.

In the dehydration step, the braking of the brake mechanism 18 against the tub shaft 12 is released and the end 21*c* of the clutch spring 21 is released by disengaging the clutch lever 23 from the sleeve 32. In this state, the drive shaft 7 is rotated by way of the motor 5 in the direction of arrow D shown in FIGS. 8 and 10. Since rotation of the drive shaft 7 in the direction of arrow D causes the clutch spring 21 to be wound up, the portion 21*b* of the clutch spring 21 is wound up about the drive shaft 7 upon rotation of the drive shaft 7 in the direction of arrow D, and the portion 21*a* of the clutch spring 21 is wound up about the tub shaft 12. Consequently, rotation of the drive shaft 7 is transmitted to the tub shaft 12, that is, the tub shaft 12 is coupled to the drive shaft 7 to be rotated therewith. In such a case, since the agitator shaft 15 is coupled with the drive shaft 7, the tub and agitator shafts 12 and 15 are rotated with the drive shaft 7, resulting in the simultaneous rotation of the rotating tub 3 and agitator 4.

In the wash or rinse step, the tub shaft 12 is braked by the brake mechanism 18 and the end 21*c* of the clutch spring 21 is fixed by engaging the clutch lever 23 with the sleeve 22. In this state, the motor 5 is forward and reverse rotated alternately, resulting in the alternate forward and reverse rotation of the drive shaft 7 and agitator shaft 15 in the directions of arrow D (direction of dehydration) and arrow E (see FIG. 10). Since the end 21*c* of the clutch spring 21 is fixed and the portion 21*b* has been loosened against the drive shaft 7, the clutch spring 21 is not wound up about the drive shaft 7. Consequently, the forward and reverse rotation of the drive shaft 7 is not transmitted to the tub shaft 12, and only the agitator shaft 15 integral with the drive shaft 7 is forward and reverse rotated. The rotational speed of the agitator shaft 15 is reduced by the reduction gear mechanism 16 and transmitted to the agitator 4 via the follower shaft 17, thereby forward and reverse rotating the agitator 4.

The brake mechanism 18 has a band-brake construction for enhancement of noise reduction and therefore, the braking force of the brake mechanism 18 inherently acts on the gear case 14 relatively intensely in one or the dehydration direction and relatively weakly in the opposite direction. In view of such circumstances, the brake mechanism 18 is provided with a coil spring 24 for preventing the gear case 14 from being rotated in the direction opposite to that of dehydration rotation.

The above-described conventional automatic washing machine has the following problem: the agitator shaft 15 and hence, the agitator 4 is alternately forward and reverse rotated in the wash step, with the result that water streams are caused in the rotating tub 3 so as to be directed in the directions that the agitator is forward and reverse rotated. Consequently, a load of clothes is moved with the water streams in the directions of the forward and reverse rotations of the agitator 4. In such a washing operation, the water streams and the movement of the clothes load cause the rotating tub 3 to undergo external forces acting in the directions of arrows A and B in FIG. 10, which forces cause the rotating tub 3 to rotatively move in the directions. In such a case, the tub shaft 12 is prevented from being rotatively moved in the direction of arrow B by the coil spring 24. However, since the tub shaft 12 depends upon the braking of the brake mechanism 18 with respect to the rotative movement thereof in the direction of arrow A, the tub shaft 12 is often rotatively moved in the direction of arrow A against the braking force of the brake mechanism 18 when the external force acting in the direction of arrow A is relatively large. The portion 21*a* of the clutch spring 21 as well as the tub shaft 12 is rotatively moved in the direction of arrow A, that is, in the direction that the clutch spring 21 is loosened. Since the end 21*c* of the clutch spring 21 is fixed, a torsional spring force acting in the return direction, that is, in the direction of arrow B, is accumulated in the clutch spring 21 with the rotative movement thereof. As shown in FIG. 11, when the clutch spring 21 is loosened such that a looseness angle T is reached, the torsional spring force accumulated in the clutch spring 21 overcomes the winding force against the tub shaft 12, with the result that the other end 21*d* of the clutch spring 21 is slipped back in the direction of arrow B and stopped at a position.

In FIGS. 10–12, reference symbol P1 indicates the position where the other end 21*d* (side of the portion 21*a*) starts rotating in the direction of arrow A, reference symbol P1′ the angular position of the end 21*d* immediately before it is slipped, and reference symbol P1″ the position where the end 21*d* is stopped after occurrence of slip. Further, reference symbol P0 indicates a slip limit position. When the end 21*d* of the clutch spring 21 is loosened in the direction of arrow A beyond an allowed looseness angle Tk in FIG. 11 in the state that the other end 21*c* of the clutch spring 21 is held at the angular position Pb in FIG. 10, the spring force accumulated in the clutch spring 21 is increased. Subsequently, in slipping back in the direction of arrow B, the end 21*d* of the clutch spring 21 reaches the slip limit position P0, with the result that the clutch spring 21 loses its looseness as a whole. In such a state, when the rotational force acts on the tub shaft 12 in the direction of arrow B or when the rotational force acts on the drive shaft 7 in the direction of arrow A, shafts 7 and 12 are immediately coupled to be simultaneously rotated. An initial looseness angle $\alpha$ (see FIG. 11) from the position P1 to P0 is previously determined to take the value of 5 degrees.

As obvious from the foregoing, in the case where the tub shaft 12 is rotatively moved in the direction of arrow A with the portion 21*a* of the clutch spring 21 in the wash step such that the clutch spring 21 is loosened, the portion 21*d* of the clutch spring 21 is slipped back nearly to the return limit position P0 when the looseness angle of the clutch spring 21 exceeds the allowed looseness angle Tk, with the result that the clutch spring 21 loses its looseness. Consequently, when the drive shaft 7 is reverse rotated in the direction of arrow E, the clutch spring 21 is loosened and the agitator shaft 15 is rotated without hindrance. However, when the drive shaft 7 is again rotated in the direction of arrow D, the drive shaft 7 and tub shaft 12 are immediately coupled since the initial looseness angle $\alpha$ has already been exceeded, resulting in the locking of the drive shaft 7 and hence, the agitator shaft 15. Consequently, the agitator 4 is not allowed to be rotated in the direction of arrow A though allowed in the direction of arrow B.

SUMMARY OF THE INVENTION

Therefore, an object of the present invention is to provide a washing machine wherein the drive shaft can be prevented from being locked during the wash and rinse steps.

The present invention has been made based on the following concept: in the case where the water streams or movement of a load of clothes in the wash and rinse steps causes the tub shaft to rotatively move together with the water streams or the clothes load, thereby causing the tub shaft side of the clutch spring to move with the tub shaft, the tub shaft side of the clutch spring is slipped back in the return direction when the clutch spring is loosened to thereby take a certain looseness angle. The looseness angle is a relative torsional angle between both ends of the clutch spring. The clutch spring may be prevented from being loosened when the torsional angle between the ends thereof is limited so as not to exceed a predetermined value.

In a washing machine of the present invention, a rotating tub is provided with a hollow tub shaft extended from the outer bottom thereof. A drive shaft is disposed so as to be axially adjacent to the extended end of the tub shaft. An agitator shaft is directly coupled with the drive shaft so as to be rotated therewith and inserted in the tub shaft. An agitator is mounted within the rotating tub so as to be rotated by the agitator shaft. An electric motor is provided for driving the drive and agitator shafts. A clutch spring is formed into a coil shape and wound about the outer peripheries of the tub and drive shafts so as to be tightly wound up about the tub shaft. The clutch spring is caused to be wound up with rotation of the drive shaft to thereby transmit rotation of the drive shaft to the tub shaft. The clutch spring has two ends. An inner cylindrical member is disposed so as to enclose the clutch spring and has an engagement portion engaging one end of the clutch spring at the drive shaft side. An outer cylindrical member has a plurality of engagement claws on the outer periphery and the inner cylindrical member is fitted within the outer cylindrical member. The inner cylindrical member is rotatable with a predetermined frictional resistance against the outer cylindrical member. A clutch lever engages any one of the engagement claws of the outer cylindrical member to thereby prevent a wind-up action of the clutch spring such that rotation of the drive shaft is prevented from being transmitted to the tub shaft. The clutch lever is disengaged from the engagement claw of the outer cylindrical member to thereby allow the clutch spring to be wound up such that rotation of the drive shaft is transmitted to the tub shaft. A brake mechanism applies a braking force to the tub shaft when one of the engagement claws of the outer cylindrical member is engaged with the clutch lever. The brake mechanism releases the braking force from the tub shaft when the engagement claw is disengaged from the clutch lever. A stopper is provided in the inner cylindrical member. The stopper includes an edge against which the other end of the clutch spring strikes when the clutch spring is loosened a predetermined amount in the rotative movement of the clutch spring in the direction that the same is loosened, against the braking force applied to the tub shaft by the brake mechanism. Thereafter, the stopper causes the inner cylindrical member to rotatively move relative to the outer cylindrical member against the frictional resistance thereof, with movement of the other end of the clutch spring.

The inner and outer cylindrical members are normally coupled with a predetermined value of frictional resistance. In the wash step, any one of the engagement claws of the outer cylindrical member is engaged with the clutch lever and one end of the clutch spring is fixed in a position. When the rotative movement of the tub shaft caused by the water streams or movement of a load of clothes in the rotating tub causes the tub shaft side of the clutch spring to rotatively move in the above-described state, the other end of the clutch spring is moved a looseness angle to thereby strike against the stopper. Thereafter, when a force acts on the stopper in the direction that the clutch spring is loosened, the inner cylindrical member is rotatively moved against the frictional resistance relative to the outer cylindrical member with movement of said other end of the clutch spring. As a result, the inner cylindrical member is rotated with the clutch spring which is maintained at the looseness angle. More specifically, the relative torsion between the ends of the clutch spring may be prevented from being increased more. Consequently, even if the other end of the clutch spring is slipped back, the slip angle thereof is not increased so as to exceed the return limit angle. Therefore, sufficient looseness may be retained in the clutch spring, thereby preventing the drive shaft from being locked.

In a modified form of the washing machine, a slip ring is interposed between the inner and outer cylindrical members. The slip ring is engaged with either of the inner and outer cylindrical members so that the inner cylindrical member is rotatable with a predetermined frictional resistance against the outer cylindrical member. Consequently, the frictional resistance between the inner and outer cylindrical members may be set with ease by means of the slip ring.

In another modified form, the slip ring is of a generally C-shape and tightly wound about the outer periphery of the inner cylindrical member with one end thereof engaged with the outer cylindrical member. Further, a friction sliding member is provided on the inner surface of the slip ring. Consequently, a clamping force (or slip torque) of the slip ring against the inner cylindrical member may be rendered stable, thereby enhancing the reliability thereof and improving the life thereof.

Other and further objects of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENTS

Figure 1:
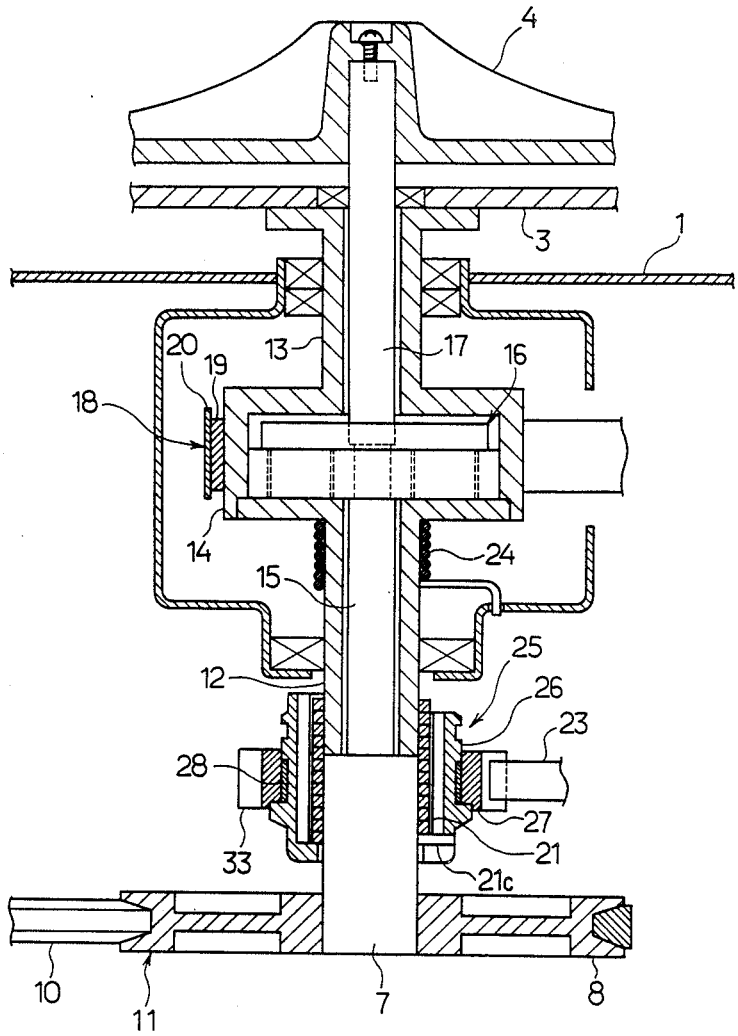
FIG. 1 is a longitudinal cross section of the major part of a washing machine of a first embodiment of the present invention.

A first embodiment of the invention will now be described with reference to FIGS. 1 to 4 of the accompanying drawings. In FIGS. 1–4, a washing machine in accordance with the present invention differs from the above-described conventional washing machine in the construction of a sleeve 25. Accordingly, identical parts are labeled by the same reference numerals that are used in foregoing description of the prior art and will not be further described herein. The sleeve 25 will now be described with reference to FIGS. 1 to 4.

Figure 2:
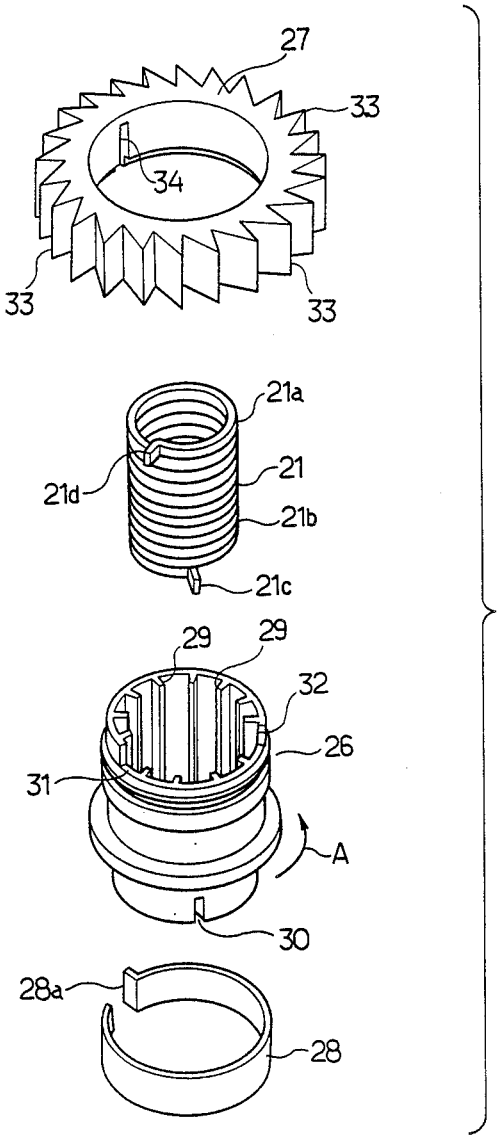
FIG. 2 is an exploded perspective view of a sleeve and clutch spring.
Figure 3:
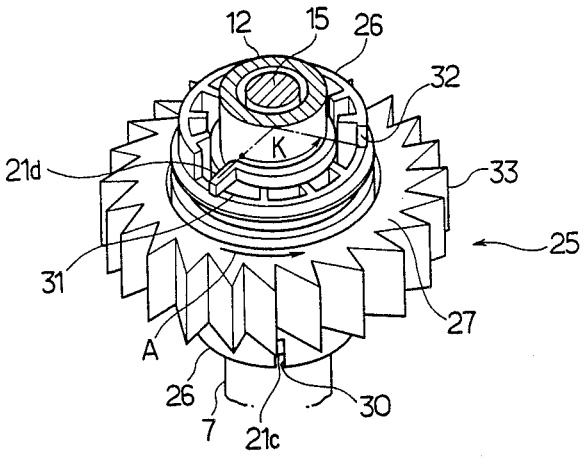
FIG. 3 is a perspective view of the sleeve portion.

Referring to FIG. 2, the sleeve 25 comprises an inner cylindrical member 26, an outer cylindrical member 27 and a slip ring 28. The inner cylindrical member 26 has a large number of ribs 29 vertically extending on the inner periphery thereof. A clutch spring 21 is received in the inner cylindrical member 26 with the ends of the ribs 29 adjacent to the clutch spring 21. The inner cylindrical member 26 has at the lower end a groove-like engagement portion 30 engaging the drive shaft side end **21*c* of the clutch spring 21 and at the upper end a circumferential cutout portion 31 which includes an edge portion at the side in the direction of which the clutch spring 21 is loosened, the edge portion serving as a stopper 32. The end 21*c* of the clutch spring 21 is engaged with the engagement portion 30 to be fixed in position. The other outwardly bent end 21*d* of the clutch spring 21 is placed within the cutout portion 31. In this disposition, the end 21*d* of the clutch spring 21 is movable in the circumferential direction within the cutout portion 31. When the clutch spring 21 is in the free state as is shown in FIG. 3, the movement of the end 21*d* of the clutch spring 21 in the direction of arrow A in which the clutch spring is loosened is limited by the stopper 32 against which the end 21*d* strikes. A movement angle K of the end 21*d*** is determined so as to be smaller than the above-described allowed looseness angle Tk.

The outer cylindrical member 27 has a large number of engagement claws 33 formed on the entire outer periphery thereof and a groove-like engagement portion 34 formed in the inner periphery thereof. The inner cylindrical member 26 is fitted within the outer cylindrical member 27 so as to be rotated.

The slip ring 28 has a generally C-shape and one end 28a thereof is outwardly bent. The slip ring 28 is wound up about the inner periphery of the outer cylindrical member 27. In this state, the end 28a of the slip ring 28 is engaged with the engagement portion 34 of the outer cylindrical member 27. In such disposition of the slip ring 28 as described above, the inner cylindrical member 26 is rotatable with a predetermined frictional resistance against the outer cylindrical member 27. More specifically, the relative movement of each of the inner and outer cylindrical members 26 and 27 is normally prevented by the slip ring 28 or they are coupled with each other. The value of the frictional resistance between the inner and outer cylindrical members 26 and 27 is so set that after the end 21d of the clutch spring 21 strikes against the stopper 32 of the inner cylindrical member 26, the inner cylindrical member 26 is allowed to rotate with movement of the end 21d thereof. The slip ring 28 has a clamping force which causes such frictional resistance as described above. The frictional resistance is determined in the following relation:

$$T2 \leqq T1 \leqq T3$$

where p T1=slip torque of slip ring 28

T2=looseness torque of clutch spring 21

T3=engagement holding torque of the clutch lever 23 relative to engagement claw 33.

Figure 4:
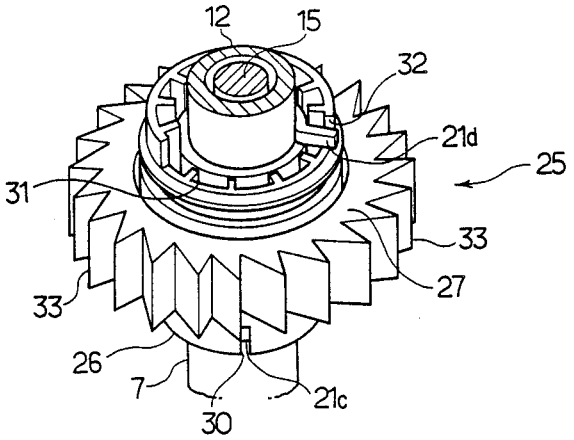
FIG. 4 is a perspective view of the sleeve portion for explanation of operation.

In operation of the above-described construction, the inner and outer cylindrical members 26 and 27 of the sleeve 25 are normally coupled by the slip ring 28. In the wash step, one of the engagement claws 33 of the sleeve 25 is engaged with the clutch lever 23 and the end 21c of the clutch spring 21 is fixed in a position. In this state, when water streams or the movement of a load of clothes causes the tub shaft 12 to rotatively move with the water streams or the clothes load with the result that the portion 21a of clutch spring 21 is rotatively moved in the direction of arrow A with the movement of the tub shaft 12, the other 21d of the clutch spring 21 is also moved in the cutout portion 31, thereby striking against the stopper 32 when the clutch spring 21 is loosened a predetermined amount, as shown in FIG. 4. Consequently, the looseness angle of the clutch spring 21 is limited to the movable angle K of the end 21d of the clutch spring 21. Thereafter, since the inner cylindrical member 26 is rotatively moved relative to the outer cylindrical member 27 against the frictional force of the slip ring 28 when further rotative movement of the tub shaft 12 in the direction of arrow A causes a force to act on the stopper 32 in the direction that the clutch spring 21 is loosened, the inner cylindrical member 26 is rotatively moved with the clutch spring 21 which is maintained at the looseness angle. More specifically, the relative torsion between the ends 21c and 21d of the clutch spring 21 is not increased more and accordingly, the looseness angle of the clutch spring 21 does not exceed the allowed looseness angle Tk. Accordingly, even if the end 21d of the clutch spring 21 is caused to slip back, the slip angle of the end 21d is not increased such that the return limit angle $\alpha$ is de-effectuated. Consequently, a sufficient looseness is thus retained in the clutch spring 21, thereby preventing the drive shaft 7 from being locked.

Since a large number of ribs 29 are formed on the inner surface of the inner cylindrical member 26 so as to axially extend, grease or the like may be retained between each rib and adjacent ones. Since the clutch spring 21 is disposed in the interior of the inner cylindrical member 26 defined by the edges of the ribs 29, a gap between the ribs 29 and the clutch spring 21 may be rendered small and precise. Should a small gap be provided between the inner surface of the inner cylindrical member 26 and the clutch spring 21 without forming the ribs, slight inclination of the inner cylindrical member or the like hinders the clutch spring 21 from being wound up and off. However, provision of the ribs 29 allows the out-of-roundness to be obtained with ease, thus preventing the above-described disadvantage.

Although, in the foregoing embodiment, the slip ring 28 is interposed between the inner and outer cylindrical members 26 and 27 such that the inner cylindrical member 26 is rotated with a predetermined frictional resistance against the outer cylindrical member 27, the outer cylindrical member 27 may be fitted in with the inner cylindrical member 26 so that the inner cylindrical member 27 has a predetermined frictional resistance without the slip ring interposed therebetween. Although the C-shaped slip ring 28 is wound up about the outer periphery of the inner cylindrical member 26 with one end 28c of the slip ring 28 engaged with outer cylindrical member 27, in the foregoing embodiment, an annular slip ring may be interposed between the inner and outer cylindrical members 26 and 27 and may be engaged with either of the cylindrical members. In further modified form, a generally C-shaped slip ring impressing a force acting in the wind-off direction on the outer cylindrical member 27 may be provided about the inner periphery of the outer cylindrical member in the compressive state or so as to press the inner periphery of the outer cylindrical member 27, instead of the slip ring 28 and one end thereof may be engaged with the inner cylindrical member 26. In this modified form, a force acts on the outer cylindrical member 27 so as to expand when the slip ring is wound off and consequently, there is a possibility that the outer cylindrical member may be broken. While, in the foregoing first embodiment, such possibility is eliminated since the slip ring 28 merely presses the outer periphery of the inner cylindrical member 26.

Figure 5:
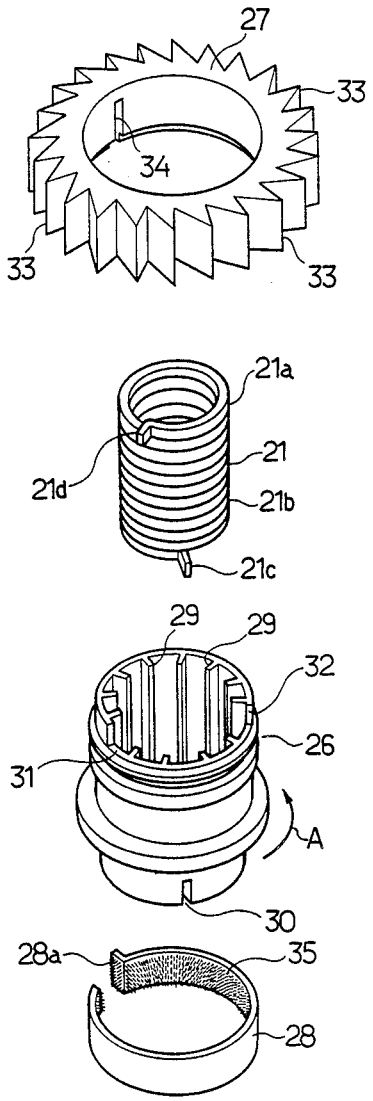
FIGS. 5 and 6 are views similar to FIG. 2 illustrating second and third embodiments of the invention, respectively.

FIG. 5 illustrates a second embodiment of the invention. The second embodiment differs from the previous embodiment in that a friction sliding member 35 is applied to the inner peripheral surface of the slip ring 28. The friction sliding member 35 is composed of fine tough synthetic fibers affixed to the inner surface of the slip ring 28 so that the fibers are raised or napped thereon.

According to the second embodiment, the slip torque of the slip ring 28 against the inner cylindrical member 26 (T1 in the first embodiment) may be maintained for a long period, thereby providing for high reliability. The experiment shows that the looseness torque T2 of the clutch spring 21 and the holding torque T3 of the clutch lever 23 take the approximate values of 0.6 kg/cm and 4 kg/cm, respectively where the interference of the clutch spring is 0.1 mm long, the number of windings thereof is 17 and the diameter of the drive shaft 7 is 25 mm long. Further, the experiment shows that the slip torque T1 of the slip ring 28 is rendered stable for a long period when the slip torque T1 set in the range between 1 and 2.5 kg/cm.

Figure 6:
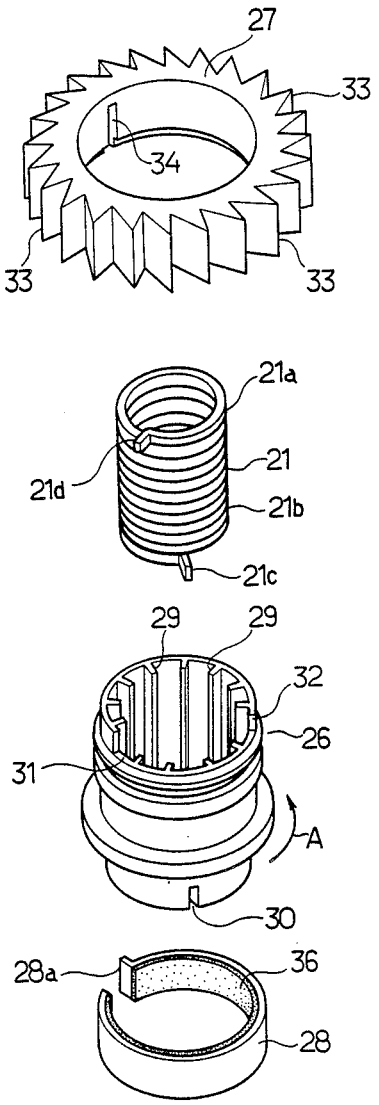
Figure 7:
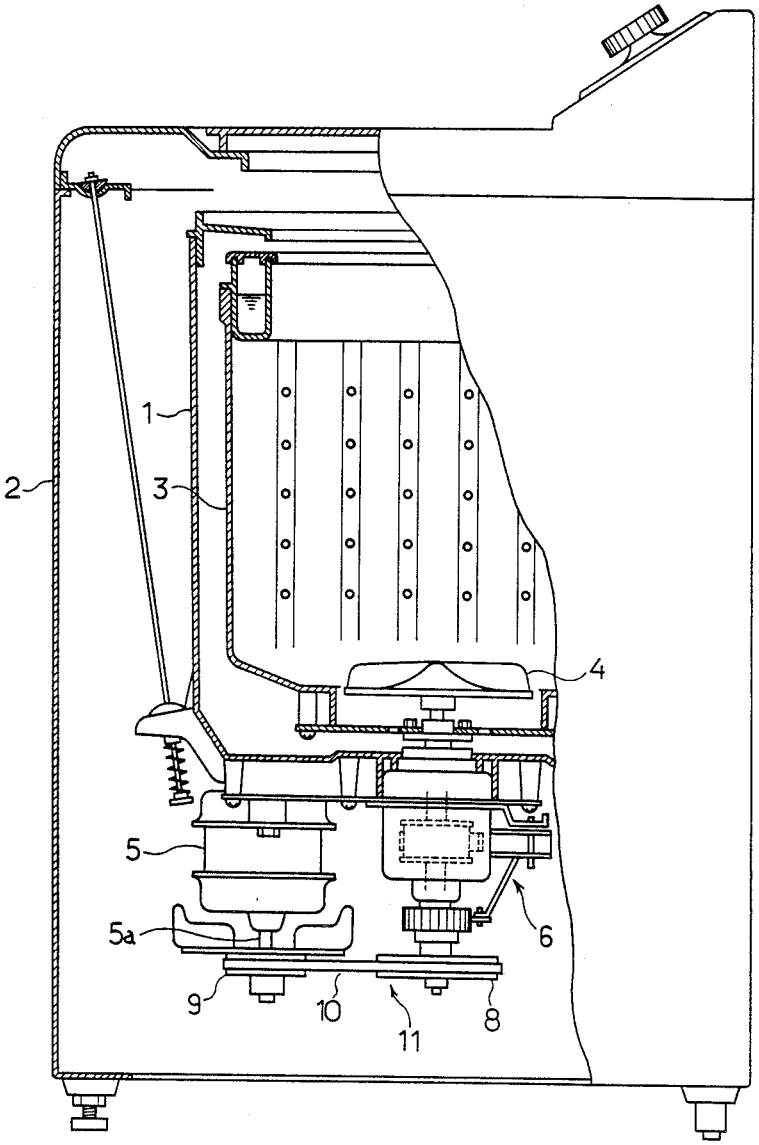
FIG. 7 (PRIOR ART)
FIG. 7 is a partially cut-away side view of a conventional automatic washing machine.
Figure 8:
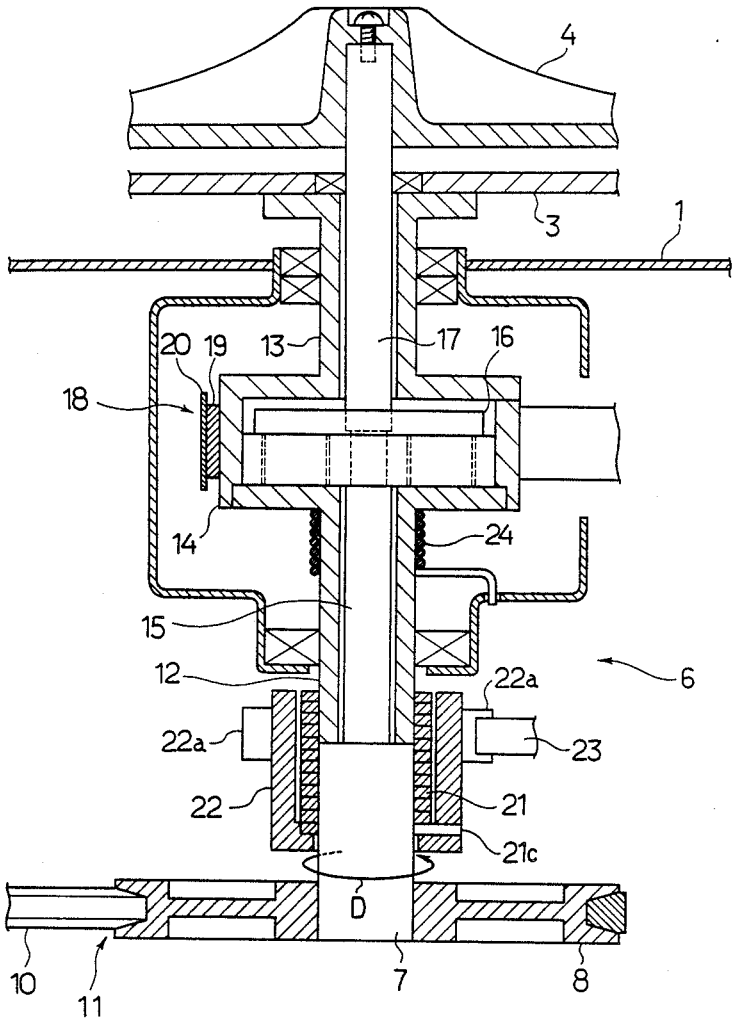
FIG. 8 (PRIOR ART)
FIG. 8 is a longitudinal cross section of the major part of the conventional automatic washing machine.
Figure 9:
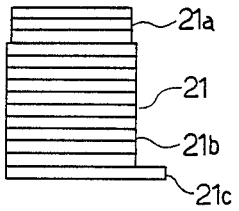
FIG. 9 (PRIOR ART)
FIG. 9 is a side view of a clutch spring of the conventional automatic washing machine in the free state.
Figure 10:
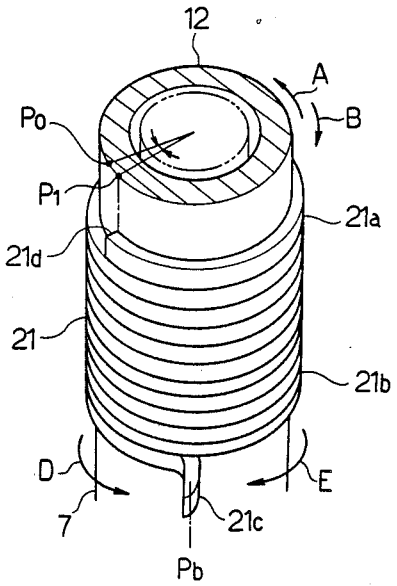
FIG. 10 (PRIOR ART)
FIGS. 10 to 12 are perspective views of the clutch spring portion of the conventional automatic washing machine for explanation of the operation.
Figure 11:
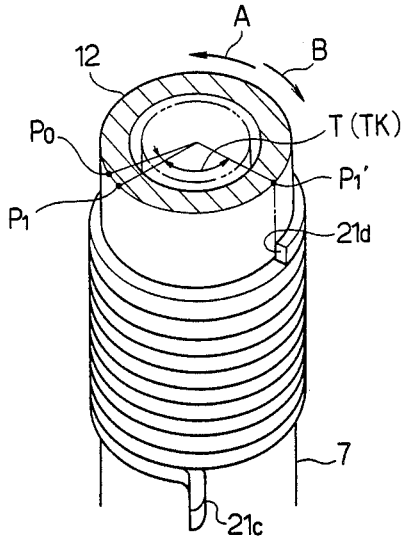
FIG. 11 (PRIOR ART)
Figure 12:
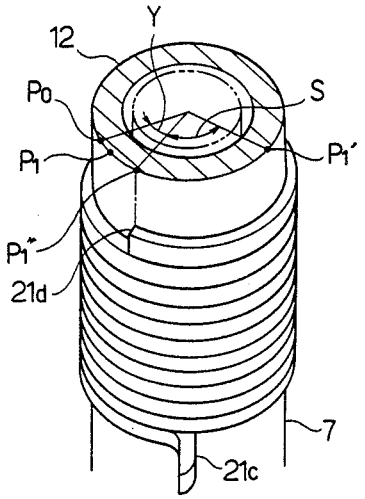
FIG. 12 (PRIOR ART)

The friction sliding member may be formed as shown at 36 in FIG. 6 illustrating a third embodiment. The friction sliding member 36 is formed from felt, as a base material, containing resin such as rubber. More specifically, after impregnated with a rubber polymer, the felt resin is dried and pressed. The rubber contained in the friction sliding member improves the abrasion-resistance thereof. The same effect may be achieved in the third embodiment as in the second embodiment.

The foregoing disclosure and drawings are merely illustrative of the principles of the present invention and are not to be interpreted in a limiting sense. The only limitation is to be determined from the scope of the appended claims.

WHAT I CLAIM IS:

1. A washing machine comprising:

(a) a rotating tub provided with a hollow tub shaft extended from the outer bottom thereof;

(b) a drive shaft disposed so as to be axially adjacent to an extended end of the tub shaft;

(c) an agitator shaft directly coupled with the drive shaft so as to be rotated therewith and inserted in the tub shaft;

(d) an agitator mounted within the rotating tub so as to be rotated by the agitator shaft;

(e) an electric motor provided for driving the drive and agitator shafts;

(f) a clutch spring formed into a coil shape and wound about the outer peripheries of the tub and drive shafts so as to be tightly wound up about the tub shaft, the clutch spring being wound up with rotation of the drive shaft to thereby transmit rotation of the drive shaft to the tub shaft, the clutch spring having two ends;

(g) an inner cylindrical member disposed so as to enclose the clutch spring and having an engagement portion engaging one end of the clutch spring at the drive shaft side;

(h) an outer cylindrical member having a plurality of engagement claws formed on the outer periphery thereof, the inner cylindrical member being fitted within the outer cylindrical member so as to be rotatable with a predetermined frictional resistance against the outer cylindrical member;

(i) a clutch lever engaging any one of the engagement claws of the outer cylindrical member to thereby prevent a wind-up action of the clutch spring such that rotation of the drive shaft is prevented from being transmitted to the tub shaft, the clutch lever being disengaged from the engagement claw of the outer cylindrical member to thereby allow the clutch spring to be wound up such that rotation of the drive shaft is transmitted to the tub shaft;

(j) a brake mechanism applying a braking force to the tub shaft when said any one of the engagement claws is engaged with the clutch lever and releasing the braking force from the tub shaft when the engagement claw is disengaged from the clutch lever; and (k) a stopper provided in the inner cylindrical member, the stopper including an edge against which the other end of the clutch spring strikes when the clutch spring is loosened a predetermined amount in a rotative movement of the clutch spring in the direction that the same is loosened, against the braking force applied to the tub shaft by the brake mechanism and thereafter, causing the inner cylindrical member to rotatively move relative to the outer cylindrical member against the frictional resistance thereof with movement of said other end of the clutch spring.

2. A washing machine according to claim 1, wherein a large number of ribs are formed on the inner surface of the inner cylindrical member so as to be axially extended.

3. A washing machine according to claim 1, wherein a cutout portion is formed in the upper end of the inner cylindrical member so as to be circumferentially extended, said other end of the clutch spring is movable within the cutout portion, and the cutout portion has one edge portion positioned at the side in the direction of which the clutch spring is loosened, the edge portion serving as the stopper.

4. A washing machine comprising:

(a) a rotating tub provided with a hollow tub shaft extended from the outer bottom thereof;

(b) a drive shaft disposed so as to be axially adjacent to an extended end of the tub shaft;

(c) an agitator shaft directly coupled with the drive shaft so as to be rotated therewith and inserted in the tub shaft;

(d) an agitator mounted within the rotating tub so as to be rotated by the agitator shaft;

(e) an electric motor provided for driving the drive and agitator shafts;

(f) a clutch spring formed into a coil shape and wound about the outer peripheries of the tub and drive shafts so as to be tightly wound up about the tub shaft, the clutch spring being wound up with rotation of the drive shaft to thereby transmit rotation of the drive shaft to the tub shaft, the clutch spring having two ends;

(g) an inner cylindrical member disposed so as to enclose the clutch spring and having an engagement portion engaging one end of the clutch spring at the drive shaft side;

(h) an outer cylindrical member having a plurality of engagement claws formed on the outer periphery thereof, the inner cylindrical member being fitted within the outer cylindrical member;

(i) a slip ring interposed between the inner and outer cylindrical members and engaged with either one of the inner and outer cylindrical members so that the inner cylindrical member is rotatable with a predetermined frictional resistance against the outer cylindrical member;

(j) a clutch lever engaging any one of the engagement claws of the outer cylindrical member to thereby prevent a wind-up action of the clutch spring such that rotation of the drive shaft is prevented from being transmitted to the tub shaft, the clutch lever being disengaged from the engagement claw of the outer cylindrical member to thereby allow the clutch spring to be wound up such that rotation of the drive shaft is transmitted to the tub shaft;

(k) a brake mechanism applying a braking force to the tub shaft when the any one of the engagement claws is engaged with the clutch lever and releasing the braking force from the tub shaft when the engagement claw is disengaged from the clutch lever; and (l) a stopper provided in the inner cylindrical member, the stopper including an edge against which the other end of the clutch spring strikes when the clutch spring is loosened a predetermined amount in a rotative movement of the clutch spring in the direction that the same is loosened, against the braking force applied to the tub shaft by the brake mechanism and thereafter, causing the inner cylindrical member to rotatively move relative to the outer cylindrical member against the frictional resistance thereof with movement of said other end of the clutch spring.

5. A washing machine according to claim 4, wherein the slip ring is formed into a generally C-shape and tightly wound up around the outer periphery of the inner cylindrical member, the slip ring having one end engaged with the outer cylindrical member.

6. A washing machine according to claim 5, which further includes a friction sliding member provided on the inner surface of the slip ring.

7. A washing machine according to claim 6, wherein the friction sliding member comprises synthetic fibers affixed to the inner surface of the slip ring so that the fibers are napped thereon.

8. A washing machine according to claim 6, wherein the friction sliding member is composed of felt as a base material.

* * * * *